US006319059B1

(12) United States Patent
Wu

(10) Patent No.: US 6,319,059 B1
(45) Date of Patent: Nov. 20, 2001

(54) SHIELDED ELECTRICAL CONNECTOR

(75) Inventor: Jerry Wu, Pan-Chiao (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/625,075

(22) Filed: Jul. 25, 2000

(51) Int. Cl.[7] ..... H01R 13/648
(52) U.S. Cl. ..... 439/607; 439/566
(58) Field of Search ..... 439/607–610, 439/569, 570, 566

(56) References Cited

U.S. PATENT DOCUMENTS 6,083,046 * 7/2000 Wu et al. ..... 439/607
6,086,429 * 7/2000 Wu ..... 439/607
6,155,876 * 12/2000 Ho et al. ..... 439/607
6,155,878 * 7/2000 Chen ..... 439/607

* cited by examiner

*Primary Examiner*—Gary F. Paumen
(74) *Attorney, Agent, or Firm*—Wei Te Chung

(57) ABSTRACT

An electrical connector (1) of the present invention includes an insulative housing (20), a number of electrical contacts (40) mounted in the insulative housing and a metallic shield (30). The metallic shield covers the insulative housing except for a bottom surface of the insulative housing. The insulative housing comprises a pair of front arms (24) and a pair of rear shoulders (26) and the metallic shield comprises a pair of side plates (34) engaged with the front arms and the rear shoulders. Each side plate forms a soldering pad (362) which is coplanar with the bottom surface of the insulative housing for soldering the electrical connector (1) to a mother circuit board.

1 Claim, 5 Drawing Sheets

SHIELDED ELECTRICAL CONNECTOR

BACKGROUND OF THE INVENTION

1. Field of the Invention

The present invention relates to an electrical connector, and particularly to a shielded Surface Mount Type (SMT) electrical connector.

2. Description of the Related Art

Electrical connectors are widely used in various fields to provide permanent or separable connections between electronic products. Many of these electrical connectors have metallic shields cover them for shielding and grounding purposes, thereby ensuring good quality signal transmission between the electronic products.

When Surface Mount Technology (SMT) is used to mount the metallic shield onto a mother circuit board onto which the electrical connector is mounted, retention between the metallic shield, the insulative housing of the connector, and the mother circuit board is an urgent concern to designers and manufacturers of the connector. If the retention is not as good as desired and spaces exist therebetween, the quality of signal transmission through the electrical connector can suffer due to Electromagnetic Inference (EMI), Electrostatic Discharge (ESD), and other problems.

Therefore, an electrical connector providing a reliable mechanical connection between the housing, the shield and the circuit board is desired.

SUMMARY OF THE INVENTION

A major object of the present invention is to provide an electrical connector which provides reliable retention between an insulative housing thereof, a metallic shield thereof and a mother circuit board onto which it is mounted.

An electrical connector in accordance with the present invention includes an insulative housing, a plurality of electrical contacts accommodated in the insulative housing and a metallic shield. The insulative housing comprises a pair of front arms and a pair of rear shoulders. Each front arm defines a recess therein and each rear shoulder defines a slot therein. The metallic shield comprises a pair of side plates each forming a finger retained in the recesses of the front arms and a bending portion extending into the slots of the rear shoulders. Each side plate further comprises a soldering pad flush with the bottom surface of the insulative housing.

Other objects, advantages and novel features of the invention will become more apparent from the following detailed description of the present embodiment when taken in conjunction with the accompanying drawings.

DETAILED DESCRIPTION OF THE INVENTION

Figure 1:
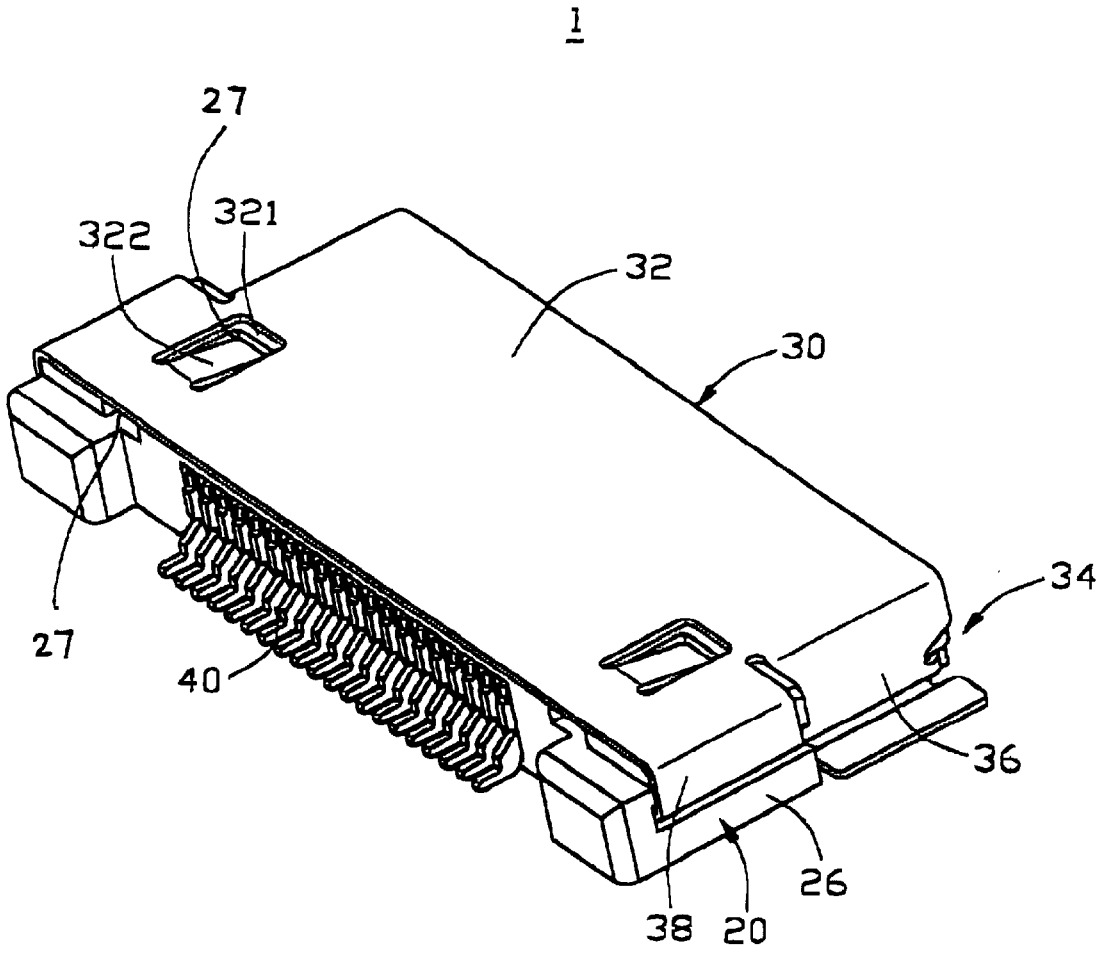
FIG. 1 is a rear and top perspective view of an electrical connector in accordance with the present invention.

Referring to FIG. 1, an electrical connector 1 in accordance with the present invention comprises an insulative housing 20, a metallic shield 30 and a plurality of electrical contacts 40. The electrical contacts 40 are conventional, so detailed descriptions of them are omitted herefrom.

Referring specifically to FIGS. 1, 2, 3 and 5, the insulative housing 20 comprises a main body 22 with a mating port 29 therein, a pair of front arms 24 forwardly extending from two sides of a front face 223 of the main body 22 and a pair of rear shoulders 26 at left and right sides of the main body 22. The main body 22 forms a pair of positioning post 221 extending downwardly from a bottom surface thereof and defines a plurality of passageways 222 through the main body 22 in a front-to-rear direction thereof. Each of the front arms 24 comprises a bottom surface 241 flush with the bottom surface of the main body 22 and an outer side surface 242. Each of the outer side surfaces 242 of the front arms 24 defines a recess 243 recessed inwardly in a lower and front edge thereof. Each of the rear shoulders 26 extends laterally outward beyond the outer side surfaces 242 of the front arms 24 and has a side wall 261 which defines a slot 262 in a middle of the height thereof.

Referring specifically to FIGS. 1–4, the metallic shield 30 comprises a main plate 32 and a pair of side plates 34 downwardly extending from left and right edges of the main plate 32. The main plate 32 defines a pair of openings 321 adjacent to a rear edge thereof and forms a corresponding pair of tongues 322 each extending forward and downward into its own corresponding opening 321 and further into the corresponding channel 27 in the housing 20. Each side plate 34 comprises a front piece 36 and a rear piece 38 spaced from the front piece 36. Each front piece 36 comprises a retention portion 361 extending perpendicularly from the main plate 32 and a soldering pad 362 bending outwardly to be perpendicular to the retention portion 361. Each retention portion 361 forms a finger 363 bending inwardly at a front and lower edge thereof. Each rear piece 38 comprises an abutting portion 381 extending perpendicularly to the main plate 32 and a bending portion 382 bending inwardly to be perpendicular to the abutting portion 381.

Figure 2:
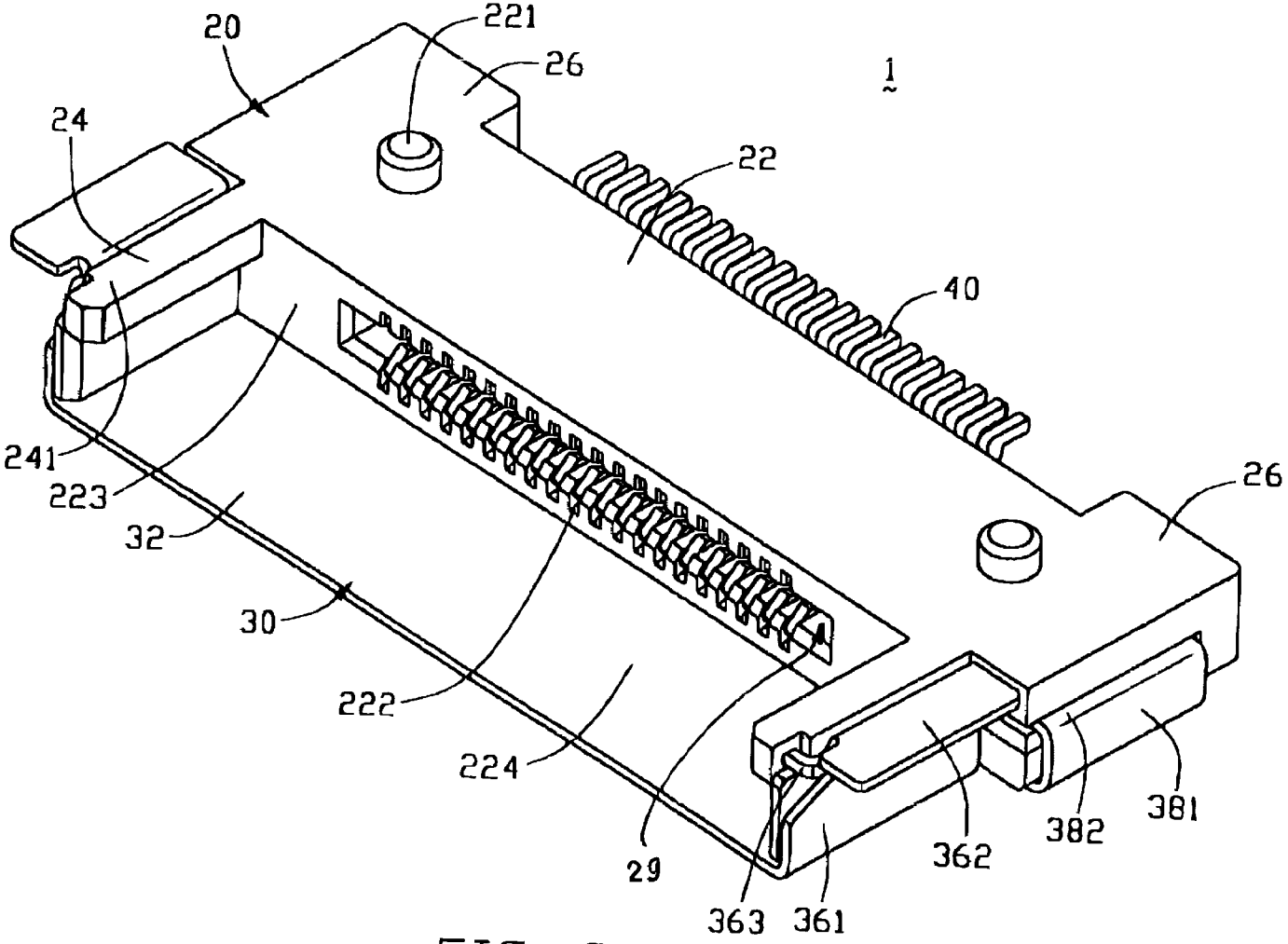
FIG. 2 is similar to FIG. 1 but taken from a front and bottom perspective.
Figure 3:
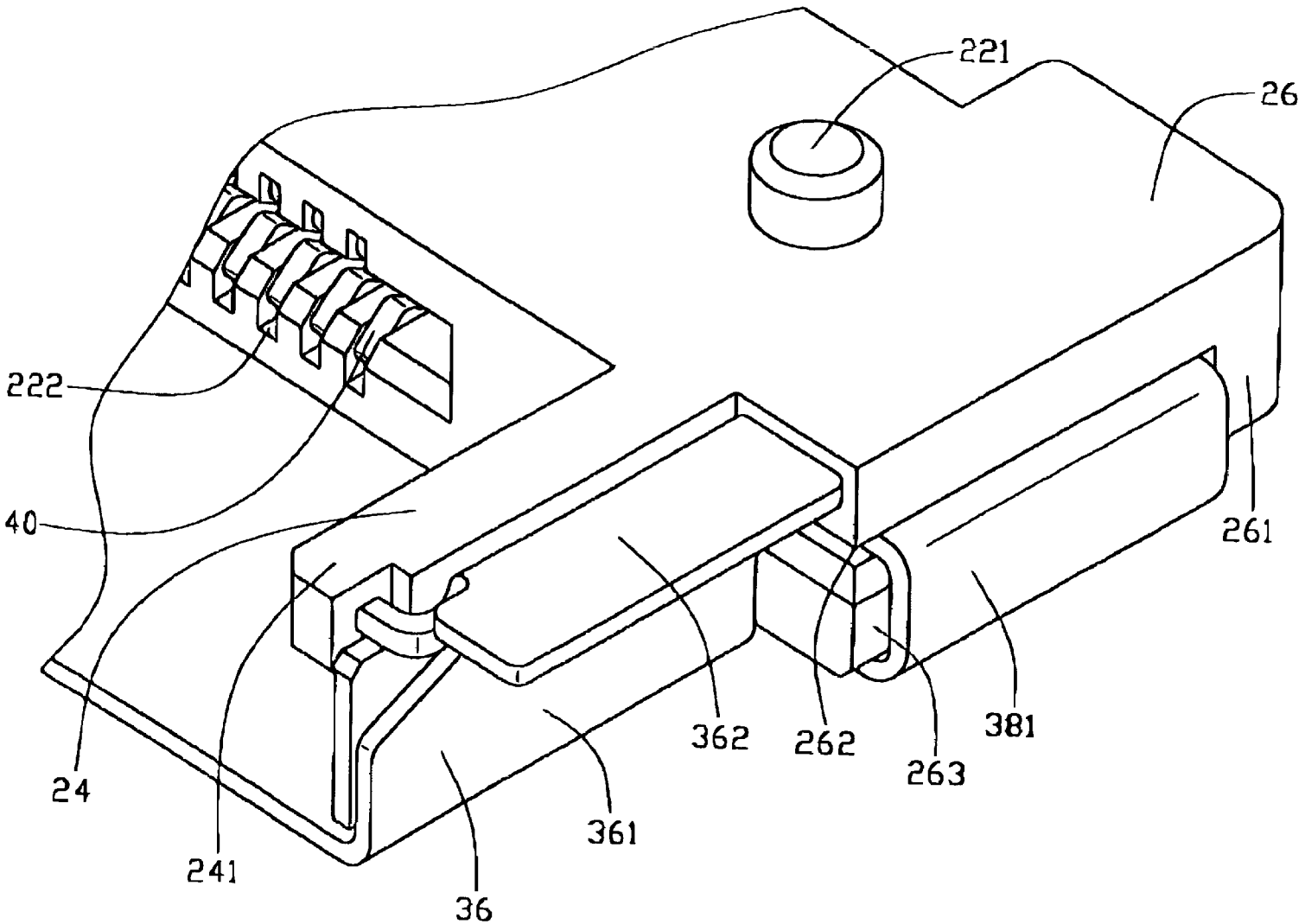
FIG. 3 is an enlarged partial view taken from FIG. 2.
Figure 4:
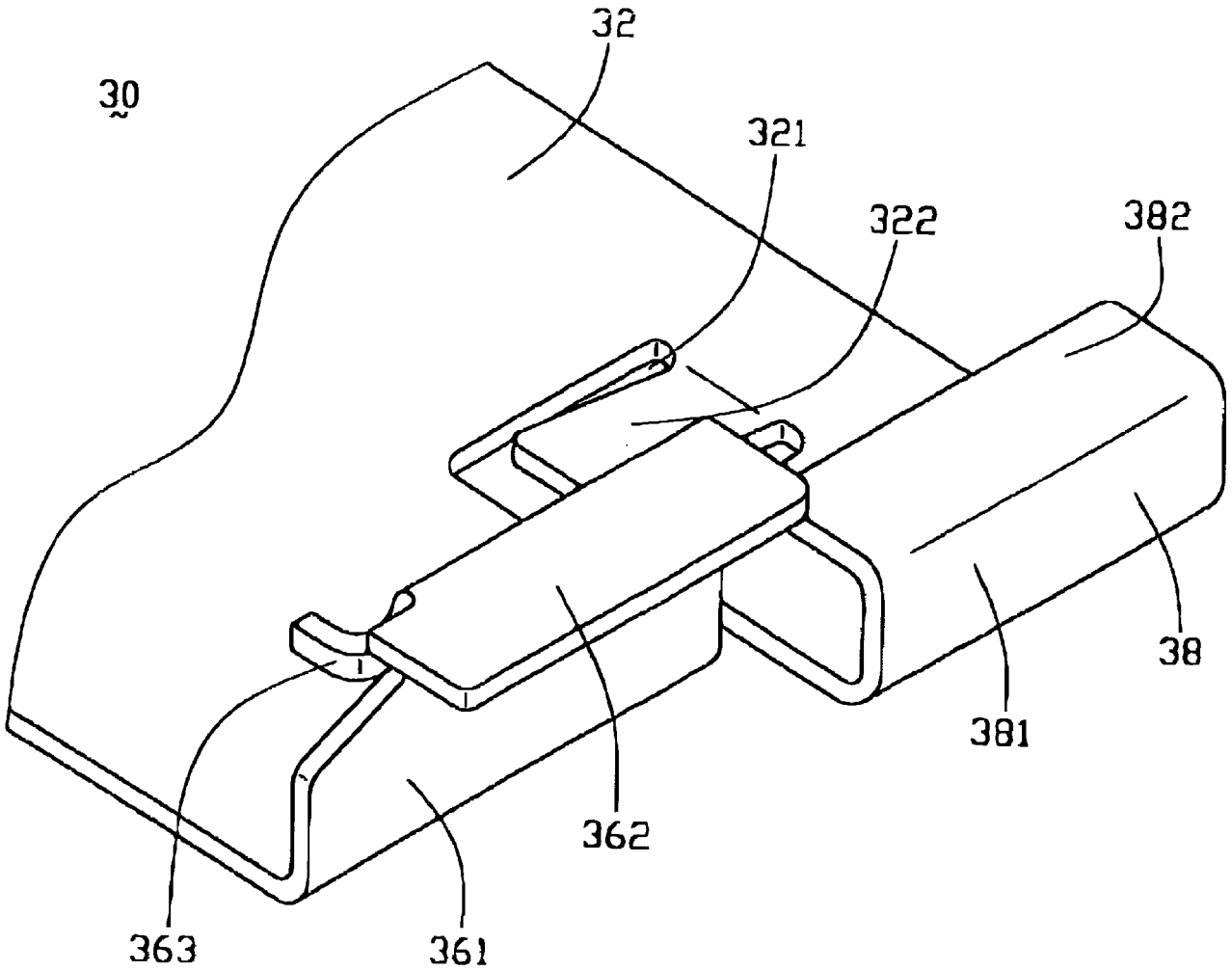
FIG. 4 is similar to FIG. 3 but only showing a part of a metallic shield of the electrical connector of FIG. 2.
Figure 5:
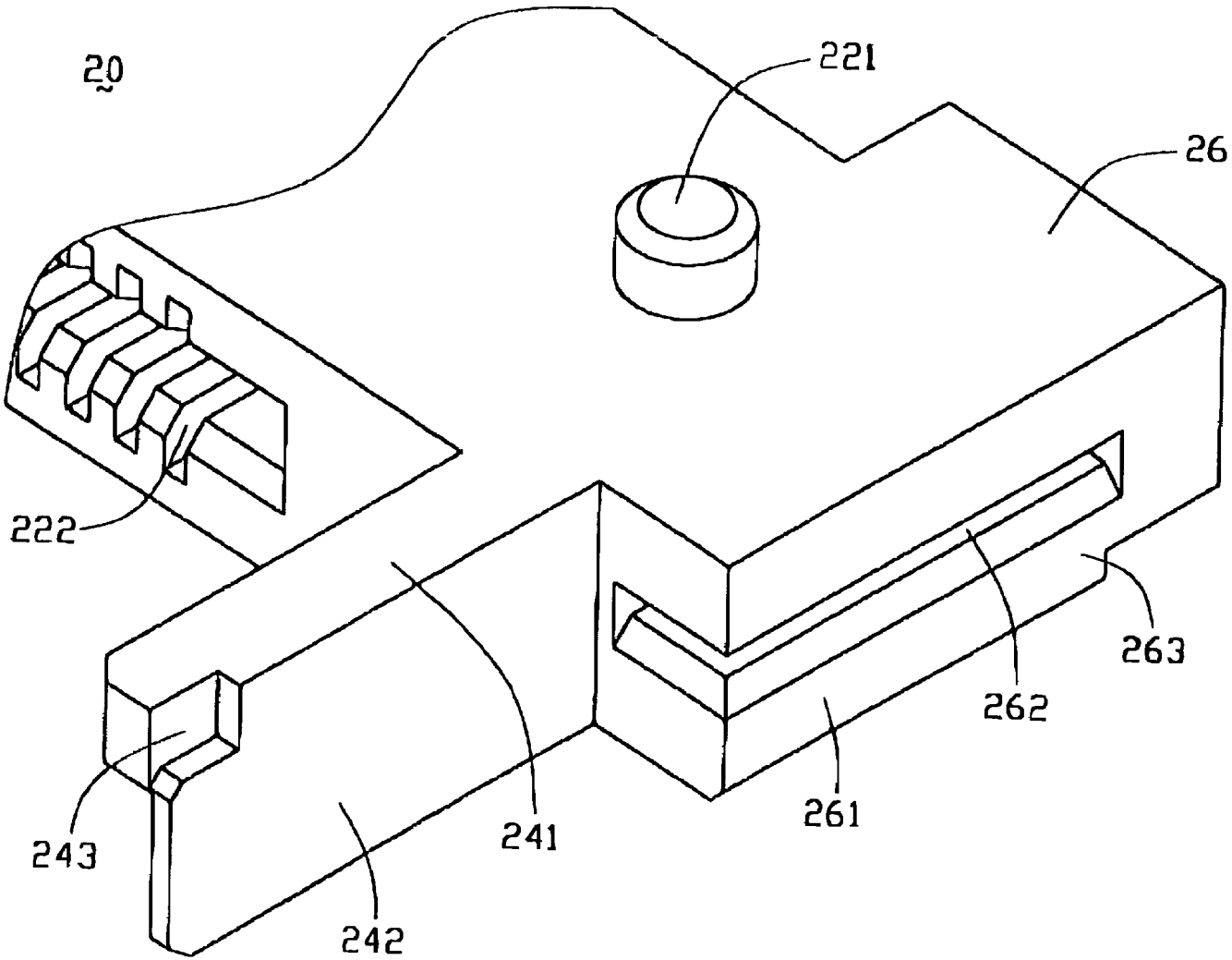
FIG. 5 is similar to FIG. 4 but only showing a part of an insulative housing of the electrical connector of FIG. 2.

Referring specifically to FIGS. 1–3, in assembly, the electrical contacts 40 are inserted into the passageways 222 of the insulative housing 20. The metallic shield 30 is assembled to the insulative housing 20. The main plate 32 substantially covers a top surface of the insulative housing 20 and a space 224 between the front face 223 of the main body 22 and the front arms 24. The retention portions 361 of the front pieces 36 cover the outer side surfaces 242 of the front arms 24, the fingers 363 extend into the recesses 243 and the soldering pads 362 are flush with the bottom surfaces 241 of the front arms 24. The abutting portions 381 abut against upper portions 263 of the side walls 261 of the rear shoulders 26 and the bending portions 382 extend into the slots 262.

The engagement between the fingers 363 and the recesses 243 and between the bending portions 382 and the slots 262 prevents the metallic shield 30 from disengaging from the insulative housing 20 in an upward direction, thereby reliably ensuring coplanarity of the soldering pads 362 and the bottom surface of the insulative housing 20. A reliable retention between the metallic shield 30 and the insulative housing 20 is thus achieved. In addition, when the electrical connector 1 is mounted to a mother board (not shown) through the soldering pads 362 and the contacts 40, the coplanarity of the shield 30 and the housing 20 will ensure a reliable soldering, and in turn retention between the electrical connector 1 and the mother circuit board. Thus, quality of signal transmission is maintained.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing having a main body defining a plurality of contact passageways each receiving an electrical contact therein, two front arms respectively extending forwardly from two sides of a front face of the main body; and a metallic shield covering a top face of the main body and the front arms and a space between the front face and the two front arms, the metallic shield forming two soldering pads located respectively beside the two front arms and adapted for being soldered to a printed circuit board by surface mounting technology, and two fingers being respectively fitted into two recesses defined in the front arms for preventing an upper movement of the soldering pads relative to the housing;

wherein each side plate of the metallic shield comprises a front piece partially covering a corresponding front arm of the insulative housing, wherein the front pieces form the fingers to be received in the recesses of the front arms;

wherein the insulative housing comprises a pair of rear shoulders at left and right sides of the main body, and each side plate of the metallic shield comprises a rear piece spaced from the front piece and partially covering one corresponding rear shoulder;

wherein the rear pieces of the metallic shield form bending portions and the rear shoulders have side walls defining slots for receiving the bend portions;

wherein the front pieces each comprise a soldering pad coplanar with a bottom surface of the front arms.

* * * * *